US005390810A

United States Patent [19]

Stroble et al.

[11] Patent Number: 5,390,810

[45] Date of Patent: Feb. 21, 1995

[54] SQUEEZE OPEN LID

[76] Inventors: Crystal L. Stroble, 78 Fernwood Dr., Murrells Inlet, S.C. 29576; William F. Stokes, Rte. 2, Box 113, Branchville, S.C. 29115; Fairey S. Bradford, P.O. Box 525, Kingstree, S.C. 29556; Nancy S. Stroble, 78 Fernwood Dr., Murrells Inlet, S.C. 29576

[21] Appl. No.: 22,810

[22] Filed: Feb. 22, 1993

Related U.S. Application Data

[63] Continuation of Ser. No. 767,019, Sep. 27, 1991, abandoned.

[51] Int. Cl.[6] ..... B65D 43/04

[52] U.S. Cl. ..... 220/281; 220/713; 220/715

[58] Field of Search ..... 220/254, 281, 711, 713, 220/714, 715

[56] References Cited

U.S. PATENT DOCUMENTS

| | | | |
|---|---|---|---|
| 3,727,808 | 4/1973 | Fitzgerald | 220/715 X |
| 4,113,135 | 9/1978 | Yamazaki | 220/268 |
| 4,184,604 | 1/1980 | Amberg et al. | 220/254 |
| 4,186,842 | 2/1980 | Albert | 220/206 |
| 4,210,256 | 7/1980 | Amberg et al. | 220/254 |
| 4,582,214 | 4/1986 | Dart et al. | 220/713 |
| 4,589,569 | 5/1986 | Clements | 220/380 |

FOREIGN PATENT DOCUMENTS

| | | | |
|---|---|---|---|
| 2219930 | 12/1989 | United Kingdom | 220/715 |

*Primary Examiner*—Allan N. Shoap
*Assistant Examiner*—Nova Stucker
*Attorney, Agent, or Firm*—Ralph Bailey

[57] ABSTRACT

Closure devices provide squeeze to open capabilities wherein a section of a lip including the rim 10 of the container may be manipulated outwardly of the closure device by squeezing the container and thereafter returned to the closure device by relaxing the squeeze. A top plating is provided below the rim engaging the container, with diverging corrugations 25 providing compressible sections 15 permitting the lip be manipulated outwardly for drinking therefrom.

7 Claims, 3 Drawing Sheets

SQUEEZE OPEN LID

This application is a continuation of application Ser. No. 07/767,019, filed Sep. 27, 1991, abandoned.

FIELD OF INVENTION

This invention relates to closure devices for containers. It relates particularly to closure devices or removable lids for containers of the types used by the fast food industry and others for dispensing liquids and other flowable products which are often put into the dispensing containers at the place of purchase and consumed or used directly from the dispensing containers with the lids on the containers.

BACKGROUND OF INVENTION

The present invention relates to improvements for closure devices for dispensing containers. Since closure devices must be compatable with the containers they are to enclose, several types of dispensing containers on which the improved closure devices provided by the present invention may be utilized will be discussed briefly. This will indicate the versatility and adaptability of closure devices of this invention.

Dispensing containers are presently used by the fast food industries and others for dispensing liquid and other flowable products. The shapes of the sidewalls of most of these containers are similar to those of sections cut from cones by two planes which lie perpendicular to the axes of the cones. The smaller ends of the containers are usually closed during the manufacturing process. The other ends which will be referred to as the top ends are generally sealed when the container is filled.

Most present dispensing containers are stamped or molded from plastic or foam materials or are formed from sheets of plastic or specially coated cardboard. The sidewalls are usually rolled outward or thickened at their tops to stiffen their rims. The resulting rims also facilitate the capping operations and provide a more pleasant touch to the users lips.

Most present dispensing containers are of the disposable type thus requiring that manufacturing costs be kept within a relatively low price range. These containers are usually capped with push-on pull-off type lids when capping is required.

Present closure devices for these dispensing containers vary somewhat in shape and structure and special features but most of them function in the same manner. Their top surfaces or plates, are usually in the shape of thin generally flat discs. They usually have special ridges and indentions and other features such as perforations for pull-out tabs and small punctures for air vents and various lettering. The top plate either seats on the top rim of the container to help effect a seal or it supports a ring or rings which provide surfaces which similarly serve that purpose.

Most present closure devices are equipped with what will be called an outer gripping ring, although some present closure devices use only what will be referred to as an inner gripping ring. Many present closure devices use both an inner and outer gripping ring and may also use what will be referred to as a support ring. These somewhat tapered gripping rings are flexible to some extent and are sized to fit relatively tightly on the rim of the enclosed container. They are thus capable of holding the enclosure devices in place on the attached containers. These rings normally also form a seal with the contacting inner and outer surfaces of the container wall.

Support rings connect the top plate to the inner gripping ring. It is often specially shaped to enable it to be compressed during placement of the closure device on the container so as to be capable of maintaining outward pressure on the inner gripping ring.

A preferred embodiment of the invention may be stamp molded from plastic and is comprised of a thin circular top plate. The edges of the top plate curve downward and extend downward at varying slopes to form a support ring. The support ring curves outward and upward and extends upward at varying slopes to form the inner gripping ring. The inner griping ring curves outward and extends generally outward to form a seat to fit against the top surface the rim of an enclosed container. It then curves downwardly and extends generally downward at varying slopes to form the outer gripping ring.

Present closure devices for dispensing containers function effectively. They do not allow the contents of the container to leak excessively and they do not fall off. They are attractive enough and since they are stamp molded they can be produced at costs which makes them suitable for disposable usage.

In spite of all this, very few users like them although food chains make sure that they are placed on all take out orders. Many of their customers would prefer that they be left off. Present closure devices are just too much trouble to take off. And doing so, particularly while .sitting is too risky. This is especially true for children. Gripping a container firmly enough to hold on to it while pulling the lid off without tilting or crushing the container is a difficult task and when the lid suddenly pops off, spillage occurs.

Adults have problems removing the lids too especially while driving. The operation requires the use of both hands and a good bit of attention. It is quite possible for a driver to look back up after having removed a lid to find the vehicle encroaching into the wrong lane or headed for the ditch, or worse. Then after the lid is removed there is the problem of finding a place to put the lid so it will not soil something or get soiled. So the lids usually end up on the floor or out a window and the user is often left with an uncovered container to hold on to. Admittedly there are present closure devices with perforations for tearing out a small section of the top for sipping, but removing them from a closed container filled with hot coffee is difficult and tedious and attention diverting and risky. Reclosing them is almost impossible.

Then too, people do not like to drink or sip through a hole in a container lid. They much prefer using the lip of the container. They also prefer not having to tilt their heads back at some awkward angle as is usually required when drinking through a hole in a lid.

SUMMARY OF THE INVENTION

One of the principal objects of the present invention is to provide closure devices for containers with the squeeze to open capabilities. These capabilities include providing the user with access to the contents of the container with the closure device fully attached to the enclosed container.

Another object of this invention is to include in the squeeze to open method of operation for closure devices a feature whereby an uncovered and bare section of the lid of the container may be projected from the closure device in response to slight increase in the normal holding pressure being applied to certain areas of the container.

Another object of the present invention is to include in the squeeze to open method of operation a feature whereby the projected section of a lip of the container may be held in the projected accessible position for dispensing by maintaining the pressure referred to above.

Another object of the present invention is to include in the squeeze to open method of operation for closure devices a feature whereby the container may be returned to approximately its original closed position inside the closure device by the release of the pressure referred to above.

Another object of the present invention is to include in the squeeze to open method of operation for closure devices the capability of repeating the opening and holding and closing operations many times.

Another object of the present invention is to provide the squeeze to open method of operation in a form or forms which may be incorporated into most closure devices for dispensing containers.

Another object of the present invention is to provide the squeeze to open method of operation in a form which allows the physical properties and characteristics of the closure device such as rigidity and flexibility and elasticity to be utilized in Conjunction with similar properties of the enclosed container to perform certain squeeze to open operations. In this way the design of some of the sections of the closure device may be varied to supplement similar properties of the container to be enclosed. This may be accomplished by adjusting the size and thicknesses and shapes of the members of the closure devices as well as in the selection of the type of plastic material to be used. It should also be pointed out that some future dispensing containers will very likely be specially designed for use with squeeze to open closure devices. This should improve to some extent the operational properties and characteristics of the unit formed by the connected container and closure device.

Another object of the present invention is to provide the squeeze to open method of operation with features which eliminate the need for pull out tabs in order to sip or drink from the containers without removing the closure devices.

Another object of the present invention is to provide the squeeze to open method of operation with features which reduce the chances of runovers or seepage from the closure device. One such feature provided is the placement of the top plate of the closure device well below the level of the top of the lid of the enclosed container.

Another object of the present invention is to provide in the squeeze to open method of operation features which provide a small reservoir for use in case of an overfill or during the initial squeeze to open operation.

Another object of the present invention is to provide the squeeze to open method of operation with features which provide a small downwardly indented nose area in the lid thus allowing the user to drink from the container with much less awkward rearward tilting of the head.

Another object of the present invention is to provide the squeeze to open method of operation for closure devices with features which make the unit formed by its connection to the proper container functional and neat and clever and simple and fascinating to operate.

Another object of the present invention is to provide the squeeze to open method of operation for closure devices with functions which may be incorporated into present and future closure devices at relatively low, if any, additional cost.

Another object of the present invention is to provide the squeeze to open method of operation with features which provide an opening in the closure device through which a section of the lip and sidewall of the enclosed container may exit and reenter the closure device. To serve this purpose, a section of the outer gripping ring at the front of the closure device is deleted. Deletion of a corresponding section of the inner gripping ring is neither necessary nor completely desirable but may simplify the stamp molding process which may be used in the production of the improved closure device.

Another object of the present invention is to provide the squeeze to open closure devices with features which include the provision of a so called stationary section of the top plate of the lid. This section, in plan view, is somewhat segment shaped. It contains a small upwardly indented area which serves as a reservoir, and a small downwardly indented area to accomodate the tip of the users nose when drinking from the enclosed container. The arc shaped rear edge of the stationary section connects to and is integral with the adjacent section of the support ring of the closure device. The sides of the stationary section join and are integral with the adjacent edges of the so called compressible sections which are discussed later. The narrow front end of the stationary section is shaped to fit snuggly against the inside wall of an enclosed container.

Another object of the present invention is to provide the squeeze to open method of operation with features which provide one or more compressible sections. The preferred embodiment utilizes two such areas which are, in plan view, generally in the shape of a section of a circle. The side portions of the are shaped edges of the compressible sections are connected to and integral with the adjacent support ring. The front portions of these edges stand free. As previously mentioned, the inner edges join the adjacent edges of the stationary section. The compressible sections are equipped with generally tapered corrugations which radiate outward from areas of the inner gripping rings and extend to the unconnected front edge of the compressible sections.

Another object of the present invention is to provide squeeze to open features which include a so called movable section. This section is comprised of an outer gripping ring and an inner gripping ring and the support ring. The back portion of this section which is adjacent to the stationary section is relatively rigid due in part to it being connected to the stationary section. The side sections are less rigid due to the flexibility of the attached flexible sections and are capable of bending inward and encroaching into the gap formed by the previously mentioned deleted section of the gripping ring or rings.

Another object of the present invention is to provide the squeeze to open method of operation with features which provide an optional tension strap which connects the ends of the outer gripping ring. This narrow strap, if utilized, may be located at an elevation far enough below the rim of the container so as not to contact the users lips when sipping from the container. It is easily looped over the container prior to placement of the main body of the closure device.

DESCRIPTION OF A PREFERRED EMBODIMENT THE INVENTION

Figure 1:
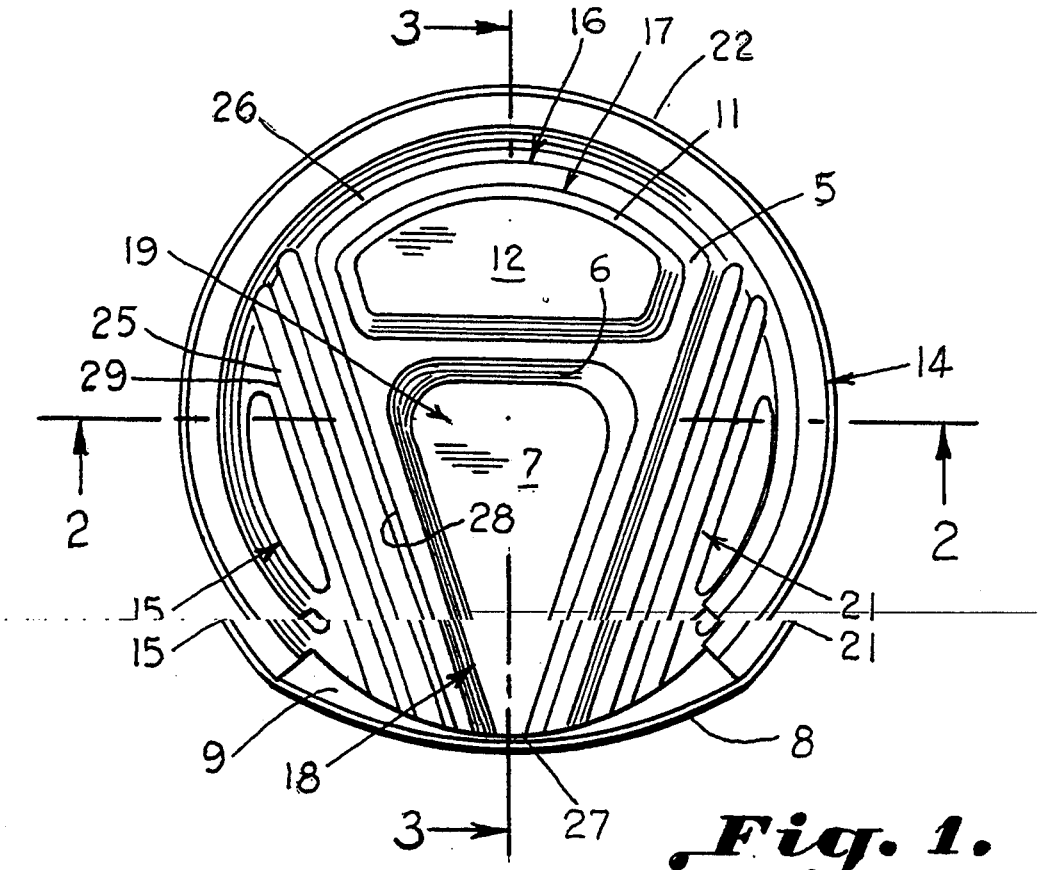
FIG. 1 is a top view of a closure device constructed in accordance with the present invention.
Figure 2:
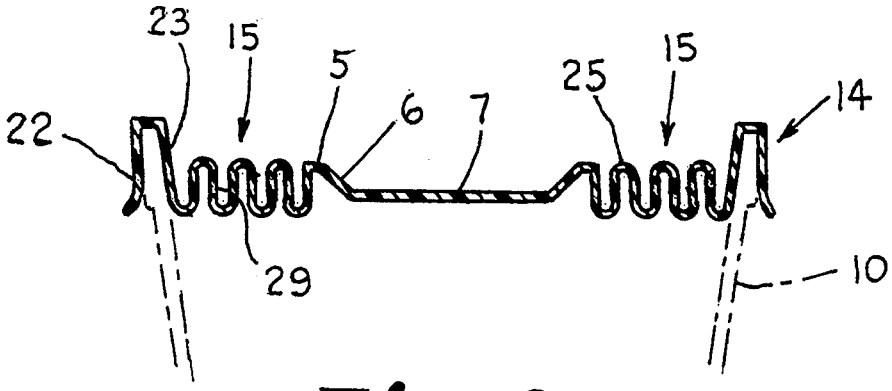
FIG. 2 is a sectional elevation view of the main body of the improved closure device taken along line 2—2 on FIG. 1.
Figure 3:
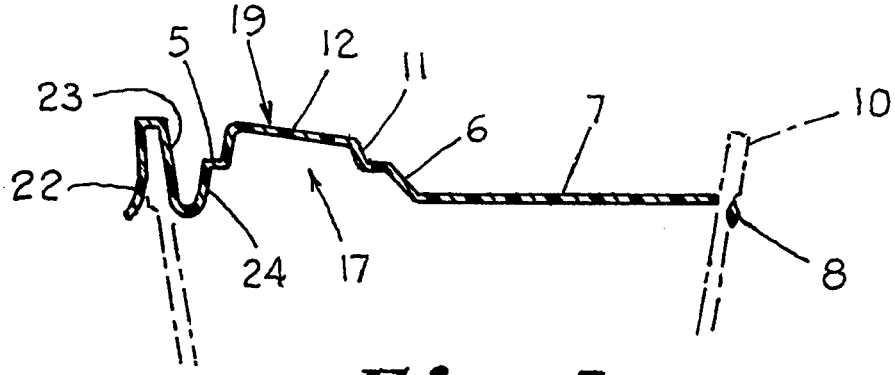
FIG. 3 is a sectional side view of the main body of the improved closure device taken along line 3—3 on FIG. 1.
Figure 4:
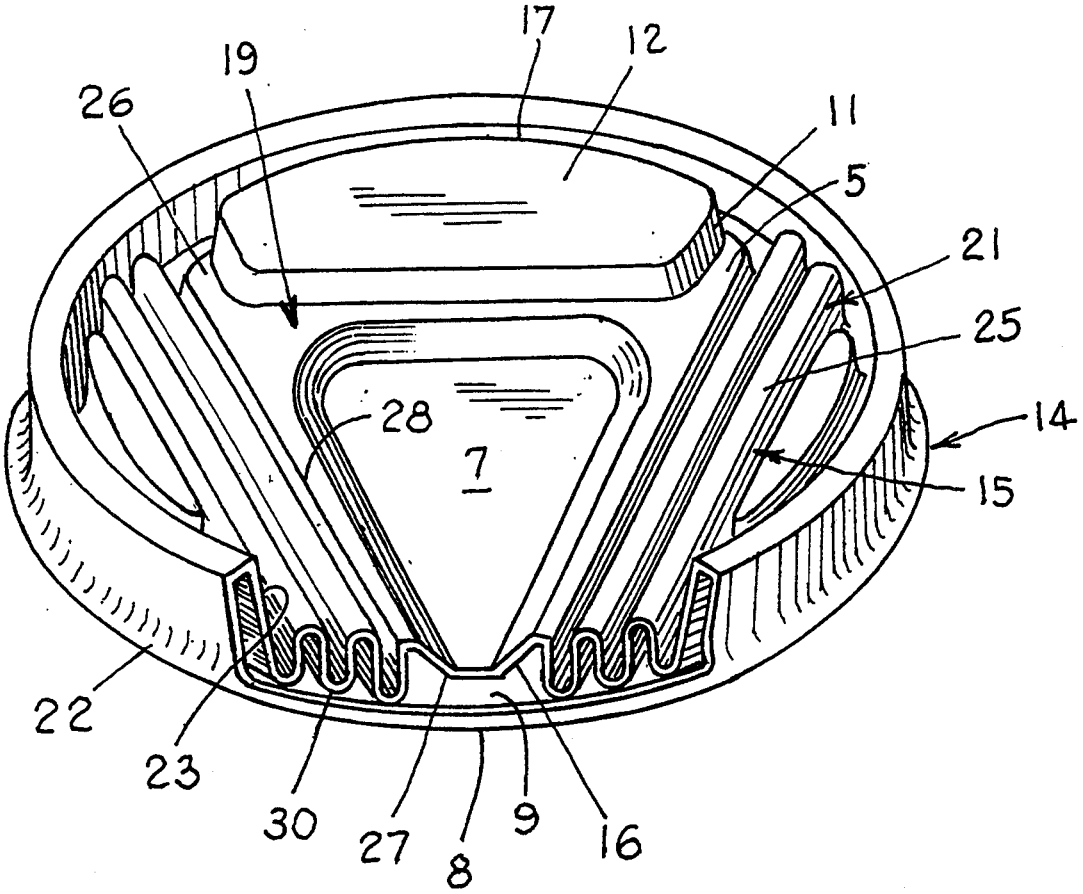
FIG. 4 is a front perspective view of the improved closure device.

FIGS. 1-4 illustrate a closure device for dispensing containers constructed in accordance with the present invention. These improvements have provided the closure device with squeeze to open capabilities.

An outer gripping ring 22, inner gripping ring 23, support ring 24 and top plate 19 are utilized in the preferred embodiment illustrated.

The top plate 19 is illustrated as including three sections. A stationary section 16 is located generally in the central area top plate 19. It divides the remaining portion of top plate 19 into two compressible areas 15.

The rear arcuate edge 26 of the stationary section 16 connects and is integral with the adjacent portion of support ring 24. The relatively narrow and also arc shaped front edge 27 abuts the inside wall of enclosed container 10 when the closure device is in the closed position. This front edge 27 is cantilevered and is shaped to seat against the inside of the wall of container 10. The sides 28 of stationary section 16 join and are integral with the adjacent edges of compressible sections 15. Stationary section 16 also contains upwardly indented reservoir 17 and downwardly indented nose area 18. It is also equipped with an indented relatively narrow ridge or ledge 5 which generally encircles section 16 and reservoir 17 and nose area 18. The primary purpose of ridge 5 is to strengthen the perimeters of section 16 and reservoir 17 and nose area 18, and the adjoining sections of the closure device. Reservoir 17 is formed by sloped reservoir sides 11 and sloped reservoir top 12 which are integral parts of top plate 19. Nose area 18 is formed by sloped sides 6 and bottom 7 which are also integral parts of top plate 19.

Compressible sections 15 are generally in the shape of a section of a circle with the side portions 29 of their arc shaped edges joining and being integral with adjacent edges of support ring 24. The arc shaped front edges 30 of compressible sections 15 are somewhat cantilever supported. These edges 30 are shaped to fit snugly against the inside wall of an enclosed container 10 when the closure device is in the closed position. Compressible section 15 also contain corrugated fields 21 which are composed of somewhat diverging corrugations 25. Corrugations 25 generally radiate out from inner gripping ring 23 and extend in straight lines to the unconected front edges 30 of sections 15 to form corrugated fields 21. The thickness of the material forming corrugated fields 21 and in certain areas of the individual corrugations may be varied to obtain to some extent the desired degrees of flexibility. The slopes and depths of the individual corrugations 25 may also be varied. For example, the shapes of the individual corrugations 25 may be changed from somewhat U and inverted U shaped cross sections to more V and inverted V shaped cross sections. The final decision of these matters will depend greatly on the physical characteristics of the plastic material used and on the characteristics of the container to be enclosed.

It should be noted that the connections of corrugations 25 with inner gripping ring 23 form somewhat inverted U shaped gaps in inner gripping ring 23. These gaps enhance to some degree the flexibility of ring 23 by providing spaces for slight shortening of rings thus diminishing the compressive stresses occurring during the opening process.

Movable section 14 includes support ring 24 and inner gripping ring 23 and outer gripping ring 22. These rings are connected to and integral with each other and to stationary section 16 and compressible sections 15 as shown on FIGS. 1-4. A section of the outer gripping ring 22 and the adjacent portions of the inner gripping ring 23 and support ring 24 of the original closure device were omitted to form gap 9. The removal of the section of inner gripping ring 23 was optional and was done to simplify the stamp molding process which is usually used in the manufacture of most closure devices for dispensing containers.

Optional tension strap 8 was added to span gap 9 and to provide tension between the ends of the outer gripping ring 22. Strap 8 may easily be looped over the container prior to final placement of the main body of the closure device on the container. It is of proper length to be drawn relatively tightly against the outer surface of the enclosed container during the placement process. Strap 8 is positioned at a level which will keep it below the top of the lid of an enclosed container 10.

Present dispensing containers on which squeeze to open closure device may be utilized are generally designed for use with or without closure devices. They are therefore capable of withstanding the side pressures normally applied by users while lifting or handling them, even when they are filled and uncapped. However, some distortion often occurs in most filled and uncapped containers when they are handled, particularly in those of the larger sizes. The side pressures on opposite sides of the containers by the fingers grasping the container often cause the rim of the container to change from a generally circular shape into a somewhat elliptical shape. This creates no serious problem for the user. He or she merely drinks from one of the ends of the lip of the resulting somewhat elliptically shaped container.

A closure device equipped with the squeeze to open features provided by the present invention adds strength and stability to rim and sidewall of an enclosed container 10. The unit formed by container 10 and the attached closure device is capable of withstanding, with very little deformation, what will be called normal pressure. For purpose of discussion, normal pressure will designate pressure normally exerted on a filled container by the user while lifting or holding the container. Pressure exceeding normal pressure to a degree that will start the opening process of the squeeze to open closure device will be called opening pressure.

Gripping rings 22 and 23 and support ring 24, by virtue of their inherent rigidities, tend to hold the rim of an enclosed container 10 in its circular shape. The resistance to bending provided by the closure device and enclosed container 10 do not, however, make the unit unyielding to pressure.

Considering only movable section 14 and enclosed container 10 unconnected from the other sections of a closure device, one notes:

(a) Although section 14 is composed of three connected rings 22–24 which are spaced some distances apart, these rings are thin and they are composed of relatively flexible material.

(b) Gap 9 provides space for the ends of rings 22–24 to move inward.

(c) The total required movement of the ends of rings 22–24 and the amount of inward bending is small.

(d) The capability of rings 22–23 to be drawn in toward ring 24 particularly at the rear of the closure device reduces the tension and shear which would otherwise develop.

(e) The inward pressure on the closure device is distributed somewhat uniformerly over a relatively large area of movable section 14 by rings 22–24 and the wall of container 10.

(f) The tendency of container 10 and rings 22–24 to change from circular shapes into a somewhat elliptical shapes in response to inward pressure tends to reduce concentrated forces that might cause overstressing and permanent deformations.

(g) The resulting generally uniform stressing of members afford the storage of energy during the opening operation for use in the closing operation of the squeeze to open closure device.

The actual operation of the squeeze to open closure device attached to a container is as follows:

(a) When operating pressure is applied to the appropriate areas of the sidewall of enclosed container 10 these areas begin to move inward.

(b) If the sidewall were unrestrained at it's top and bottom ends, the horizontal cross section of the entire sidewall would begin to change from circular to somewhat elliptical shapes.

(c) However, the rigid bottom of container 10 will not allow the bottom area of the wall to change shape. This causes most of the force and inward movement to be transferred or reflected toward the top of the wall.

(d) The somewhat arced shape of the areas of the wall to which the pressure is being applied enhances the sidewalls ability to resist bending and to distribute to some degree the force over the entire length of container 10.

(e) Rings 22–24 of the closure device receive and help redistribute inward force around the closure device while also holding the connected areas of the sidewall of container 10 in a somewhat circular shape.

(f) The rear portion of movable section 14 connects to relatively rigid stationary section 16 which will allow very little inward motion.

Figure 5:
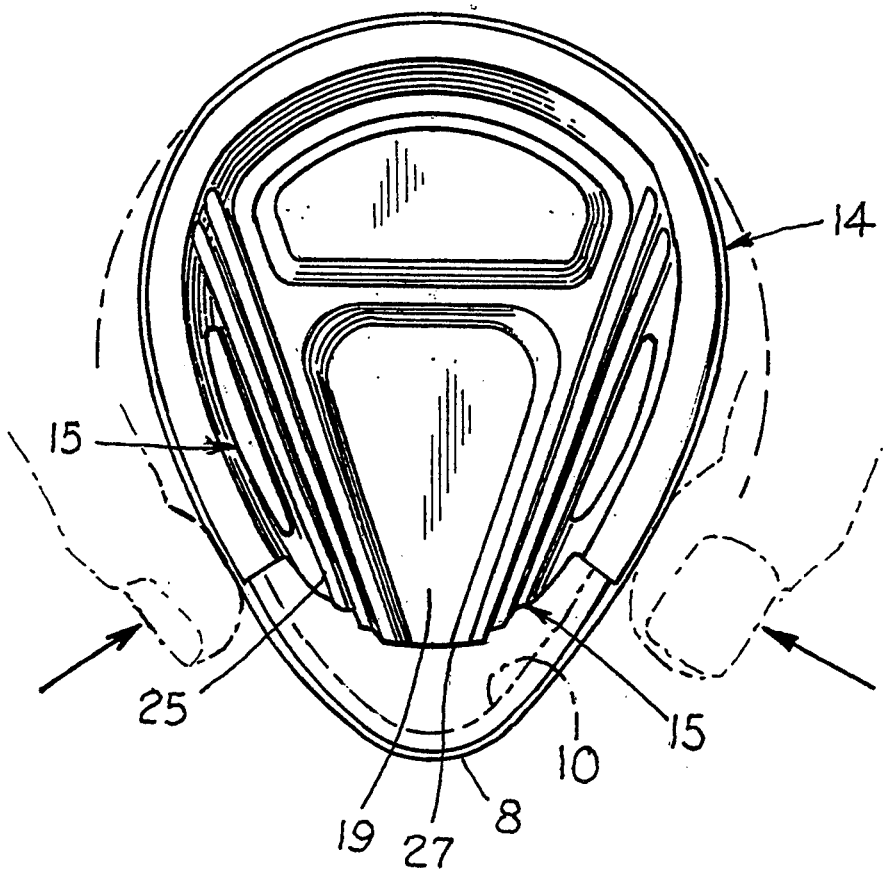
FIG. 5 is a top plan view illustrating the closure device with adjacent container portions in extended position facilitating drinking from the cup.

(g) The flexibility of compressible sections 15 allow the adjacent portions of movable section 14 to bend and swing inward. This action moves the ends of movable section 14 into gap 9 and causes the shape of the front section of container 10 to become somewhat elliptical as illustrated in FIG. 5.

(h) The resulting somewhat circular shape of the back section of container 10 and the somewhat elliptical shape of its front section results in an overall shape somewhat similar to a cross sectional view of an egg.

(i) As the opening process continues, the protruding somewhat elliptically shaped front section of container moves further from the closure device until it is suitably positioned for easy sipping or drinking therefrom.

(j) Tension strap 8 is easily pushed out by the protruding lip of container 10, since their lengths are comparable. Strap 8 also applies a small amount of tension to the ends of outer gripping ring 22.

(k) By maintaining the inward pressure on container 10, the container is held in its open position.

(l) Release of pressure on the sides of container 10 allows the energy stored in the container and in the closure device during the opening operation to easily reclose the unit by simply reversing the opening process.

We claim:

1. A closure device providing squeeze to open capabilities for covering an open top of a flexible, resilient beverage container, said open top being defined by an upper rim with an inside wall, said closure comprising:

a flexible, resilient top plate;

an arcuate front edge on said top plate for abutting against an opposite portion of said inside wall of said upper rim; and compressible sections comprising a plurality of corrugations in the top plate on each side of said arcuate front edge radiating to said arcuate front edge so that said top plate compresses upon the application of a squeezing force for permitting a portion of the upper rim opposite said arcuate front edge on said top plate to flex outwardly from said arcuate front edge thereof.

2. The closure device set forth in claim 1 including outer and inner gripping rings integral with an edge of said top plate and extending about said top plate for receiving said rim therebetween; and a gap in the outer gripping ring of the closure device through which said portion of the rim may flex outwardly and providing space for adjacent sections of the outer and inner gripping rings to be moved inwardly.

3. The closure device set forth in claim 1 wherein said compressible sections in the top plate are composed of relatively thin plastic and said corrugations radiate out from sections of the inner gripping ring and converge inwardly to the arcuate front edge.

4. The closure device set forth in claim 3 including a stationary section in the top plate of the closure device, said stationary section containing strengthening ridges and ledges as well as an upwardly indented reservoir and a downwardly indented area for reception of the projecting tip of a users nose.

5. The closure device set forth in claim 4 including gripping rings which are sufficiently flexible to allow inward flexing in response to inward pressure from a gripped sidewall of the enclosed container while providing support for holding the gripped section of the rim of the enclosed container in a regularly curved shape thus enhancing the ability of the wall of the enclosed container to resist the bending moment resulting from inward pressure when applied by the user, said gripping rings also transferring pressure to the portion of the rim of the enclosed container during the opening process thus adding to the distance a lip of the container is projected during the opening process.

6. The closure device set forth in claim 5 wherein the gripping rings and the compressible sections of the closure device store energy during the opening process which, upon relaxation of inward pressure on the container by the user, reverses the opening process and returns the container and closure to approximately their original closed positions.

7. The closure device set forth in claim 6 wherein the top plate of the closure device is constructed to be in used spaced below the level of the top of the rim of the enclosed container thus reducing the chance of runovers due to overfills or other causes.

* * * * *